United States Patent [19]

Sillen et al.

[11] 3,940,021

[45] Feb. 24, 1976

[54] CAR HAVING PLURAL SIDE POURING LADLES

[75] Inventors: Rudolf Valentin Sillen; Eric-Olof Sjögren, both of Ronneby, Sweden

[73] Assignee: Kockums Jernverksaktiebolag, Kallinge, Sweden

[22] Filed: Apr. 3, 1975

[21] Appl. No.: 564,803

[30] Foreign Application Priority Data

Apr. 11, 1974 Sweden ..... 7404981

[52] U.S. Cl. ..... 222/129; 164/130; 222/166

[51] Int. Cl.[2] ..... B22D 41/04; B22D 41/12

[58] Field of Search ..... 222/129, 166; 164/130, 164/322, 337; 105/263, 256; 298/7, 8, 10

[56] References Cited

UNITED STATES PATENTS

| | | | |
|---|---|---|---|
| 484,019 | 10/1892 | Iles | 105/263 |
| 2,088,546 | 7/1937 | Camerota | 222/166 |
| 2,151,683 | 3/1939 | Busche | 164/130 |
| 3,334,884 | 8/1967 | Suzuki et al. | 222/166 X |

*Primary Examiner*—Robert B. Reeves
*Assistant Examiner*—David A. Scherbel
*Attorney, Agent, or Firm*—Ostrolenk, Faber, Gerb & Soffen

[57] ABSTRACT

Apparatus for pouring metals having a reciprocatory ladle car with two tiltable cradles for removably carrying ladles. The ladles in the two cradles are mirror-inversed and have their pouring spouts directed substantially in the same direction and substantially transverse to the direction of travel of the car. The tilting shafts of the cradles are substantially colinear with the center line of the spouts of the ladles placed in the cradles.

4 Claims, 3 Drawing Figures

CAR HAVING PLURAL SIDE POURING LADLES

The present invention relates to an apparatus for pouring metal into moulds which have been manufactured in automatic moulding machines.

In order to be able to utilize an automatic moulding machine to the full, it is necessary int.al. that the pouring be carried out without reducing the cycle time of the machine and without otherwise causing unnecessary stoppages.

The conventional apparatus for pouring consists of a ladle with a refractory lining, the ladle being supported by a pulley block adjacent the line of moulds and being manually tilted. Because the metal temperature in the ladle rapidly decreases, the metal contents of the ladles must be restricted to that which is normally consumed within 5–10 minutes, the ladles being then refilled with new metal.

A typical automatic moulding machine has a total production cycle time of 12 seconds. The time required for moving the moulds one step forward is 3 seconds. As a rule, the effective pouring time utilized lies close to the maximum permissible which, in the above-mentioned example, is 9 seconds. Consequently, a ladle must be changed within 3 seconds in order to avoid stopping the moulding machine. Even if several ladles are in continuous operation, change times in the region of 1 minute are not unusual. In a change rate of 10 ladles per hour, the operation stoppages caused by ladle changes will thus amount to approximately 15%.

A number of pouring apparatuses in which attempts have been made to solve the above-indicated problems are available on the market. The majority of the prior art solutions to the pouring problem are based on the idea that molten metal must be constantly available. Thus, according to one prior art solution, a furnace hearth is placed above the moulds and provided with a stopper and a nozzle brick. According to another prior art solution, a furnace has been placed beside the moulds, from which furnace pouring is effected by establishing gas excess pressure in the furnace hearth or by utilizing electro-magnetic runners.

These prior art solutions are associated with the following disadvantages, as compared with conventional ladle pouring;

1. The metal quality cannot be changed until the entire furnace hearth has been emptied.
2. There are certain operational problems because of wear to the refractory details, stopper, nozzle brick.
3. In the pouring of different cast-iron qualities, the metal is normally inoculated before use. The inoculation effect fades within approximately 10 minutes, for which reason the pouring should take place within this period of time. In the event of possible extended stoppages of the moulding machine, there is thus a risk that the inoculation effect has disappeared when the pouring process is restarted.
4. In the prior art pouring apparatuses, the pouring rate is difficult to regulate. However, for the casting of goods made to order, in which rapid model changes with varying pouring rates are normal occurrences, the ability to regulate the pouring rate is an essential requirement.

Pouring apparatuses are also known, in which two ladles can be placed on a ladle car and be tilted hydraulically. However, in the prior art apparatuses, the tilting shafts are parallel to the travel of the car and the ladles are emptied over a lip. As a result, the distance between the outlet means of the ladles is such (approx. 1 m) that ladle change by movement of the car cannot be effected in a sufficiently short time. Moreover, the stream of metal "shifts" as the ladles are tilted.

The object of the present invention is to solve the abovementioned problems in a simple and practical manner.

Thus, the present invention relates to a pouring apparatus for pouring metals, preferably for use in association with automatic moulding machines, the pouring apparatus comprising a ladle car with two pouring ladles removably placed thereon. According to the invention, the car of the pouring apparatus is provided with two tiltable cradles whose tilting shafts are directed substantially transversely to the travel of the car. Moreover, the cradles are mounted in mirror-inversed relation to each other and the pouring ladles may be placed thereon in the intended positions, the ladles in both cradles being mirror-inversed in relation to each other and each having a pouring spout directed such that its centre line, when the ladle is placed in its intended location in the cradle, substantially coincides with an extension of the tilting shaft of the cradle in question.

The invention will be described in greater detail hereinbelow and with reference to the accompanying drawings on which;

Figure 1:
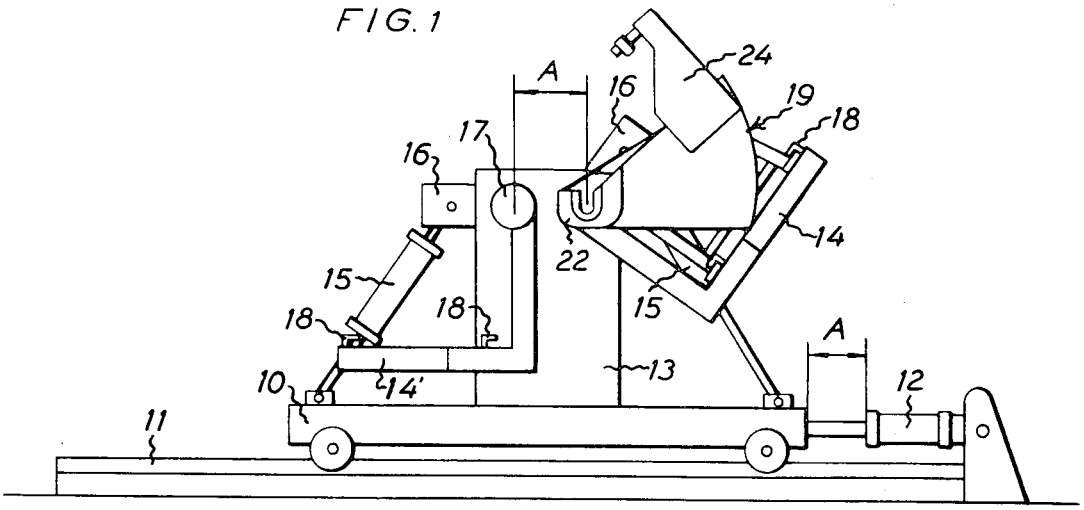
FIG. 1 is a side elevation of an apparatus according to the invention.

FIG. 1 shows an embodiment with a rail-borne car 10 movable a distance A along a path of travel defined by the rails 11 by means of a hydraulic ram 12. The car is provided with an upwardly directed stand 13 with heavy-duty bearings. The stand supports two mirror-inversed cradles 14 which may be tilted upwardly by means of hydraulic rams 15. These hydraulic rams are interposed between the car 10 and a crank arm 16 which in its turn is connected to the cradle 14 by the intermediary of a shaft 17 journaled in the bearings of the stand 13. The cradles are provided with means, for example hooks 18 for retaining the ladles 19. On the drawing, only one of the ladles 19 is placed in its cradle 14 on the car 10. The other ladle has been lifted off to effect a ladle change.

Figure 2:
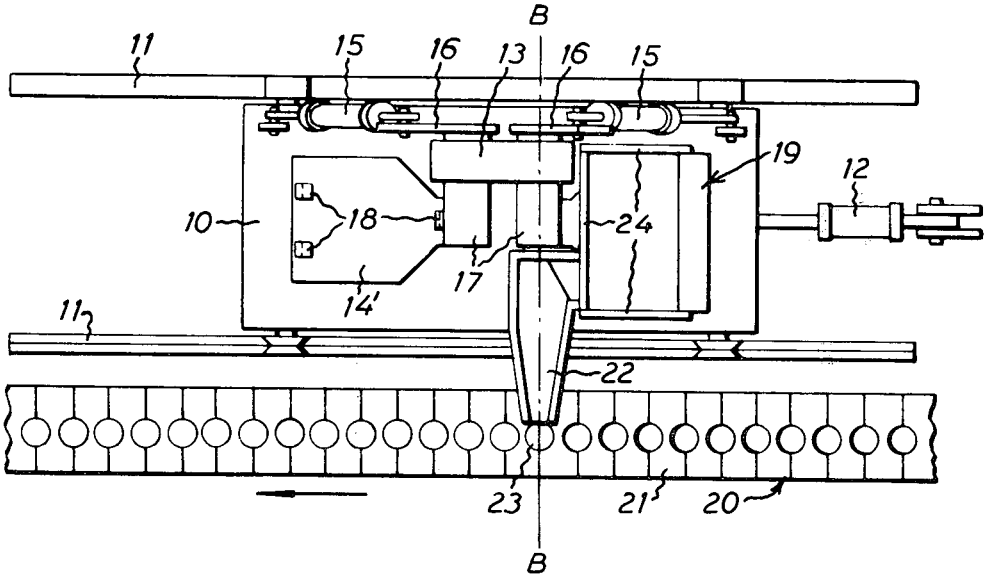
FIG. 2 is a top plan view of the apparatus in FIG. 1.
Figure 3:
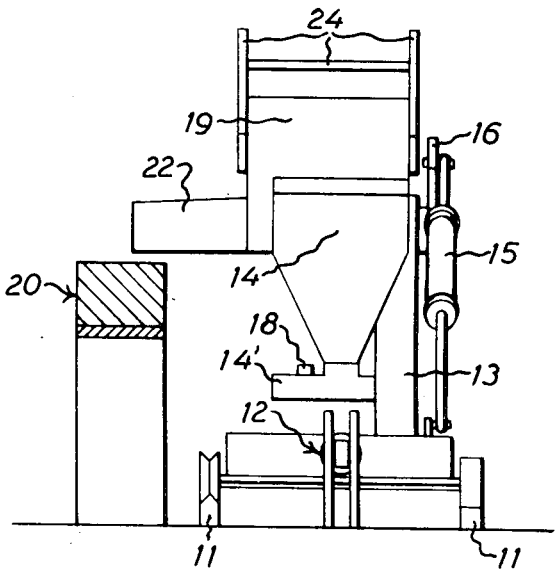
FIG. 3 shows the apparatus as seen from the right in FIG. 1.

FIG. 2 shows the apparatus of FIG. 1 seen from above and illustrates moreover a line 20 along which a series of moulds 21 dispensed from a moulding machine (not shown) is moved. The spouts 22 of the ladles are shaped such that the metal stream hits the gates 23 of the moulds 21 during the pouring process and such that the position of the metal stream is not changed at different angles of tilt, that is to say, at different angular positions of the cradle 14. The ladles are provided with a lifting yoke 24 or the like so that they can easily be lifted out of the cradles, for example, by means of a truck, for refilling with molten metal. As a result of this arrangement, the distance between the spouts 22 on both of the ladles 19 is kept very short, even if the ladles 19 are of relatively large volume. This arrangement entails that the transfer from pouring with one ladle on one cradle 14 to pouring with another ladle, which in this instance is placed on the other cradle 14', can be effected very rapidly in that the car can be moved by means of the hydraulic ram 12 a distance corresponding to the distance A between the spouts.

When the pouring apparatus according to the present invention is in operation, a full ladle 19 is placed on one cradle, the hydraulic ram 12 being moved to its one extreme position corresponding to the pouring position indicated by means of the dash-dot line B—B. Pouring is started when the hydraulic ram 15 on that section of the car in question, is caused to tilt the ladle 19 upwardly so that the metal will flow out through the spout 22 and down into the mould gate 23. The metal flow rate during the pouring is regulated by the movement of the hydraulic ram 15. Preferably, the ladle 19 is shaped such that its cross-section is in the form of a sector of a circle. As a result, the same amount of metal will flow out for each degree of tilt, whereby regulation of the pouring process will be uniform until the ladle is completely emptied. The pouring is discontinued when the hydraulic ram 15 is caused to tilt the ladle backwards in a direction towards the initial position. During the time that the ladle placed on the right-hand section of the car is employed in the pouring operation, a newly-filled ladle is placed on the opposing cradle 14' (to the left on the drawing). The transfer from pouring with one ladle to pouring with the other ladle is effected when the ram 12 is caused to move the car 10 a distance A which essentially corresponds to the distance between the spouts of the ladles. The movement is effected at the same time as the moulding machine stepwise advances a newly produced mould.

In one embodiment of the pouring apparatus according to the present invention, a distance A is 400 mm, and ladle-change can be effected in 3 seconds. The tilting mechanism is here designed as a hydraulically operated toggle joint (not shown) which permits an adjustable quick-tilting of 1°–5°, and a screw jack (not shown) which is powered by a thyristor-controlled d.c. motor. The toggle joint is used to start and stop the pouring, while the screw jack is used for the necessary continuous upward tilting which is required to regulate the pouring rate.

In the apparatus shown on the drawings the hydraulic ram 12 is arranged to reciprocate the car a distance A which is equal to the distance between the centre lines of the spouts 22 of the ladles placed in the cradles.

However, the hydraulic ram 12 may be replaced by any other type of drive.

In the embodiment shown on the drawings the centre lines of the pouring spouts are parallel to each other and the tilting shafts 17 are also parallel to each other and are horizontal. If it is desired to further reduce the distance between the outlets of the spouts, the tilting shafts 17 may be inclined relative to each other so that they approach each other in a direction toward the points of the spouts and so that the spouts thus make an angle with the line of moulds other than a right angle.

Another possibility (also omitted from the drawings) is a slight inclination of the tilting shafts 17 in relation to the horizontal plane so that the spouts will slope gently downwardly toward the gates 23 of the moulds, thereby ensuring a better running of metal from the ladles.

The apparatus according to the present invention may be modified in a number of ways without departing from the spirit and scope of the appended claims and the above description should not, therefore, be considered as limitative of the scope of the invention.

What we claim and desire to secure by Letters Patent is:

1. An apparatus for pouring metals, preferably for use in association with automatic moulding machines, comprising a ladle car, arranged for travelling back and forth along a path of travel, two tiltable cradle means mounted in mirror-inversed relation to each other on said car, tilting shafts for said cradle means mounted on said car and extending substantially transversely to said path of travel of said car, means for tilting said cradle means by rotation about said tilting shafts, a removable ladle in each of said cradle means, said ladles in said cradle means being mirror-inversed to each other, and pouring spouts on said ladles, said pouring spouts having centerlines substantially colinear with the respective axes of said tilting shafts.

2. An apparatus according to claim 1 wherein said tilting shafts are arranged beside one another.

3. An apparatus according to claim 1 wherein said tilting shafts are horizontal and at substantially right angles to the direction of travel of said car.

4. An apparatus according to claim 1 having motor means for driving said car back and forth along said path of travel.

* * * * *